US007958699B2

(12) United States Patent
Honegger

(10) Patent No.: US 7,958,699 B2
(45) Date of Patent: Jun. 14, 2011

(54) APPARATUS AND METHOD FOR COMPRESSING AND BAGGING A LOOSE MATERIAL

(75) Inventor: Chris Allen Honegger, Bluffton, IN (US)

(73) Assignee: Rethceif Enterprises, LLC, Ossian, IN (US)

( * ) Notice: Subject to any disclaimer, the term of this patent is extended or adjusted under 35 U.S.C. 154(b) by 164 days.

(21) Appl. No.: 12/316,342

(22) Filed: Dec. 11, 2008

(65) Prior Publication Data

US 2010/0146908 A1 Jun. 17, 2010

(51) Int. Cl.
*B65B 63/02* (2006.01)

(52) U.S. Cl. ..... 53/439; 53/436; 53/523; 53/529; 53/530

(58) Field of Classification Search ..... 53/439, 53/436, 450, 523, 526, 529, 530, 567; 141/73; 100/3

See application file for complete search history.

(56) References Cited

U.S. PATENT DOCUMENTS

| | | | | | |
|---|---|---|---|---|---|
| 2,955,529 | A | * | 10/1960 | Marble | 100/215 |
| 2,984,172 | A | | 5/1961 | Roberts et al. | |
| 3,088,499 | A | | 5/1963 | Rieger | |
| 3,363,396 | A | | 1/1968 | Lockrow et al. | |
| 3,451,185 | A | * | 6/1969 | Tezuka | 53/397 |
| 3,585,925 | A | | 6/1971 | Fox | |
| 3,802,337 | A | * | 4/1974 | St-Hiliare | 100/98 R |
| 3,824,758 | A | | 7/1974 | Hart et al. | |
| 4,036,359 | A | | 7/1977 | Strickland, Jr. | |
| 4,062,169 | A | | 12/1977 | Lister et al. | |
| 4,408,438 | A | * | 10/1983 | Rewitzer | 53/438 |
| RE31,944 | E | | 7/1985 | Stromberg | |
| 5,226,269 | A | | 7/1993 | Stoltenberg | |
| 5,687,643 | A | * | 11/1997 | Felts et al. | 100/3 |
| 5,694,742 | A | | 12/1997 | Elliott et al. | |
| 5,701,723 | A | * | 12/1997 | Simpson | 53/435 |
| 5,943,846 | A | | 8/1999 | Pollock | |
| 5,987,858 | A | * | 11/1999 | Long | 53/529 |
| 6,112,501 | A | | 9/2000 | Pollock | |
| 6,318,053 | B1 | * | 11/2001 | Frank et al. | 53/586 |
| 6,321,645 | B1 | | 11/2001 | Pollock | |
| 6,427,424 | B1 | | 8/2002 | Pollock | |
| 6,865,862 | B2 | * | 3/2005 | Daoust et al. | 53/438 |
| 6,922,978 | B2 | * | 8/2005 | Gualchierani | 53/529 |
| 7,055,424 | B1 | * | 6/2006 | Bielli | 100/18 |
| 7,210,404 | B2 | * | 5/2007 | Minamoto et al. | 100/3 |

* cited by examiner

*Primary Examiner* — Thanh K Truong
(74) *Attorney, Agent, or Firm* — George Pappas

(57) ABSTRACT

An apparatus for compressing a loose material that includes a compression chamber. Movement of a first ram discharges the loose material in a compressed state through an outlet port in the compression chamber. A packaging receptacle is positioned proximate the outlet port to receive the compressed material. The packaging receptacle is then moved to a second position where the movement of a second ram ejects the compressed material from the inner volume of the packaging receptacle. The second ram may be alternatively extended into and retracted from the packaging receptacle during ejection of the compressed material. The refilling of the compression chamber for the next cycle may begin prior to the retraction of the second ram from the packaging receptacle. A packaging jacket may be positioned about the packaging receptacle such that the ejection of the compressed material injects the compressed material into the packaging jacket.

26 Claims, 13 Drawing Sheets

APPARATUS AND METHOD FOR COMPRESSING AND BAGGING A LOOSE MATERIAL

BACKGROUND OF THE INVENTION

1. Field of the Invention

The present invention relates to the packaging of a loose material such as a compressible material.

2. Description of the Related Art

Various packaging apparatus are known for packaging loose materials such as compressible or free flowing materials. Compressible materials such as insulation are often packaged using equipment that compress the material and place it in a packaging jacket such as a plastic bag. Oftentimes, such materials are compressed within a vertical tower and the compressed material is discharged from the tower directly into a plastic bag. While known systems are effective at compressing and packaging compressible materials, further improvements are desirable.

SUMMARY OF THE INVENTION

The present invention provides an apparatus for compressing and packaging loose material that includes a packaging receptacle to receive the loose material after it has been compressed. The packaging receptacle is then moved to a second location where the compressed material within the packaging receptacle is ejected. By utilizing a moveable packaging receptacle, the discharge of the compressed material is decoupled from the insertion of the compressed material into a packaging jacket facilitating an increase in the operational speed and throughput of the apparatus.

The invention comprises, in one form thereof, an apparatus for compressing a loose material that includes a compression chamber having an inlet port and an outlet port. The loose material is received into the compression chamber through the inlet port and discharged from the compression chamber through the outlet port. Movement of a first ram discharges the loose material in a compressed state through the outlet port. A packaging receptacle having an inner volume is moveable between first and second positions. In the first position, the packaging receptacle is positioned proximate the outlet port and the inner volume is positioned to receive the compressed material discharged through the outlet port by the first ram. In the second position, the packaging receptacle is positioned proximate a second ram wherein movement of the second ram ejects the compressed material from the inner volume.

In some embodiments, the compression chamber may also include a compression ram that is reciprocally moveable between a fill position and a compress position and wherein the first ram reciprocally moves between an initial position and a discharge position. When the apparatus operates in a cyclic manner, loose material is input into the compression chamber and the compression ram is then moved from the fill position to the compress position and thereby compresses the loose material into a portion of the compression chamber proximate the outlet port. Movement of the first ram from the initial position to the discharge position discharges the loose material in a compressed state through the outlet port and into the inner volume of the packaging receptacle. Following the discharge of the compressed material through the outlet port and entry of the compressed material into the inner volume, the packaging receptacle and the second ram perform a product ejection operation. In the product ejection operation, the packaging receptacle is moved from the first position to the second position and the second ram is moved from a return position to an ejection position thereby ejecting the compressed material from the inner volume. The apparatus operates such that, prior to the completion of the product ejection operation by the packaging receptacle and the second ram, the movement of the first ram from the discharge position to the initial position and the movement of the compression ram from the compress position to the fill position is initiated.

In some of the embodiments, the reciprocal movement of the second ram between the return position and the ejection position alternatively extends and retracts the second ram into and from the inner volume of packaging receptacle. During the cyclic operation of such an apparatus, the first ram may be returned to its initial position and the compression ram returned to its fill position and additional loose material input into the compression chamber prior to the second ram being retracted from the inner volume of the packaging receptacle.

In some embodiments, the apparatus may include a dispensing mechanism dispensing a plastic film with the dispensed plastic film forming a sleeve about the packaging receptacle and wherein the material ejected from the inner volume by the ejection ram is received and confined within the sleeve which thereby forms a packaging jacket. The apparatus may also include at least one sealing apparatus operable to thermally join the plastic film proximate the second opening wherein ejection of the material from the inner volume engages the material with the joined plastic film and thereby simultaneously disposes the material within the plastic film sleeve disposed about the packaging receptacle and draws additional plastic film from the dispensing mechanism onto the packaging receptacle. The thermal joining of the plastic film proximate the second opening simultaneously separates the filled packaging jacket from the plastic film remaining on the packaging receptacle.

The invention comprises, in another form thereof, a method of compressing a compressible material. The method includes inputting a first batch of compressible material into a compression chamber and compressing the first batch of compressible material within the compression chamber. A packaging receptacle is provided and is moveable between a first position and a second position and defines an inner volume. The method also includes positioning the packaging receptacle in the first position and discharging the first batch of compressible material from the compression chamber in a compressed state and into the inner volume, moving the packaging receptacle from the first position to the second position with the first batch of compressed material disposed within the inner volume, and ejecting the first batch of compressed material from the packaging receptacle. A second batch of compressible material is input into the compression chamber prior to ejecting the first batch of compressed material from the packaging receptacle.

The invention comprises, in yet another form thereof, a method of compressing a compressible material. The method includes inputting the compressible material into a compression chamber and compressing the material within the compression chamber. A first ram moveable between an initial position and a discharge position and a packaging receptacle moveable between a first position and a second position and defining an inner volume are also provided. The packaging receptacle is positioned in the first position and the compressible material is discharged from the compression chamber into the inner volume in a compressed state by movement of the first ram toward the discharge position. A second ram moveable between a return position and an ejection position is provided. The packaging receptacle is moved from the first position to the second position with the compressed material disposed within the inner volume. The compressed material is ejected from the packaging receptacle by movement of the second ram toward the ejection position while the packaging receptacle is in the second position.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figure 1:
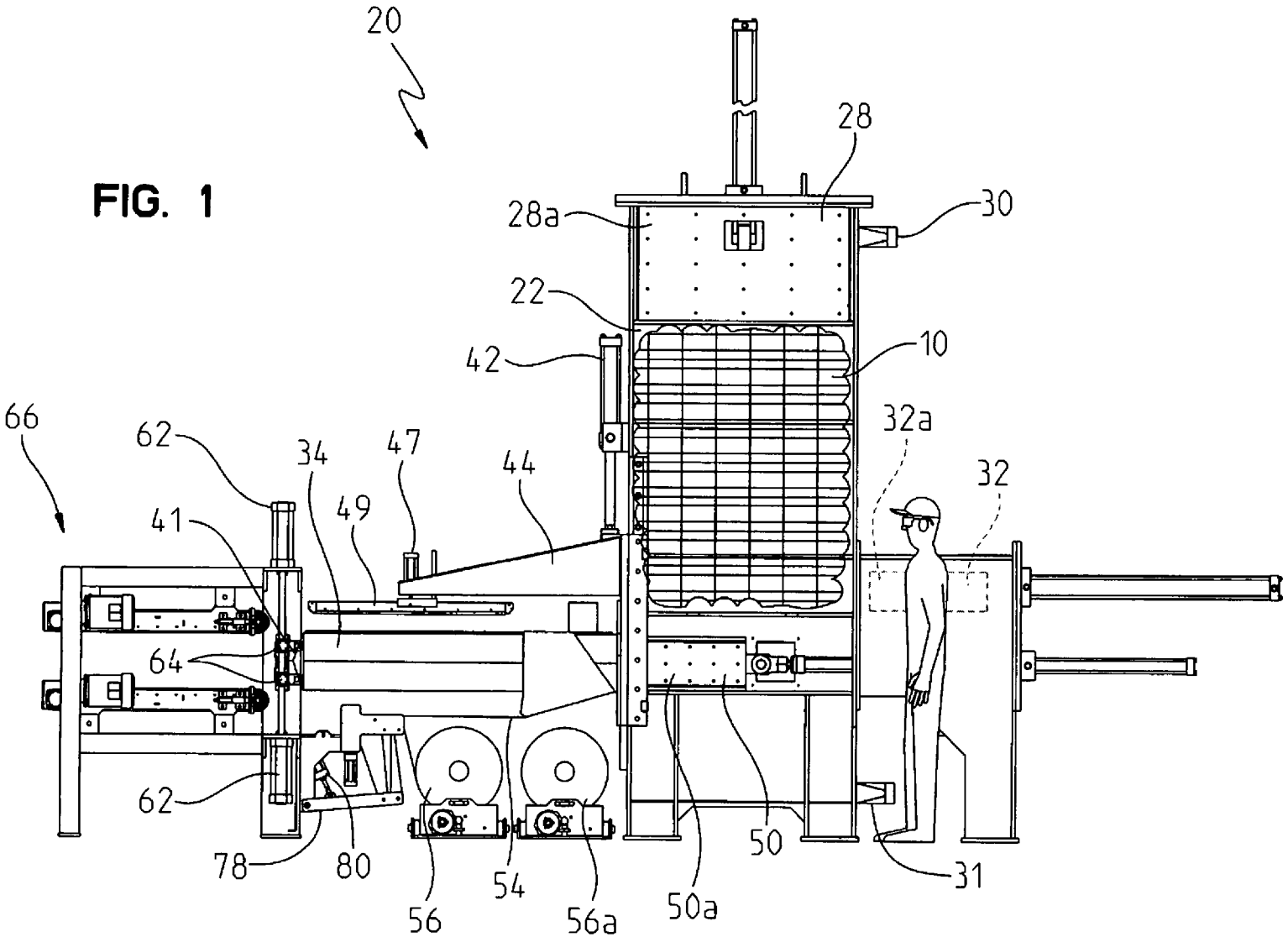
FIG. 1 is a schematic view illustrating an apparatus for compressing a material in an initial point in the compression cycle.

Corresponding reference characters indicate corresponding parts throughout the several views. Although the exemplification set out herein illustrates an embodiment of the invention in one form, the embodiment disclosed below is not intended to be exhaustive or to be construed as limiting the scope of the invention to the precise form disclosed.

DETAILED DESCRIPTION OF THE INVENTION

An apparatus 20 for compressing a compressible material in accordance with the present invention is shown in FIGS. 9-13. FIGS. 1-8 provide a schematic illustration of the operation of apparatus 20.

Figure 10:
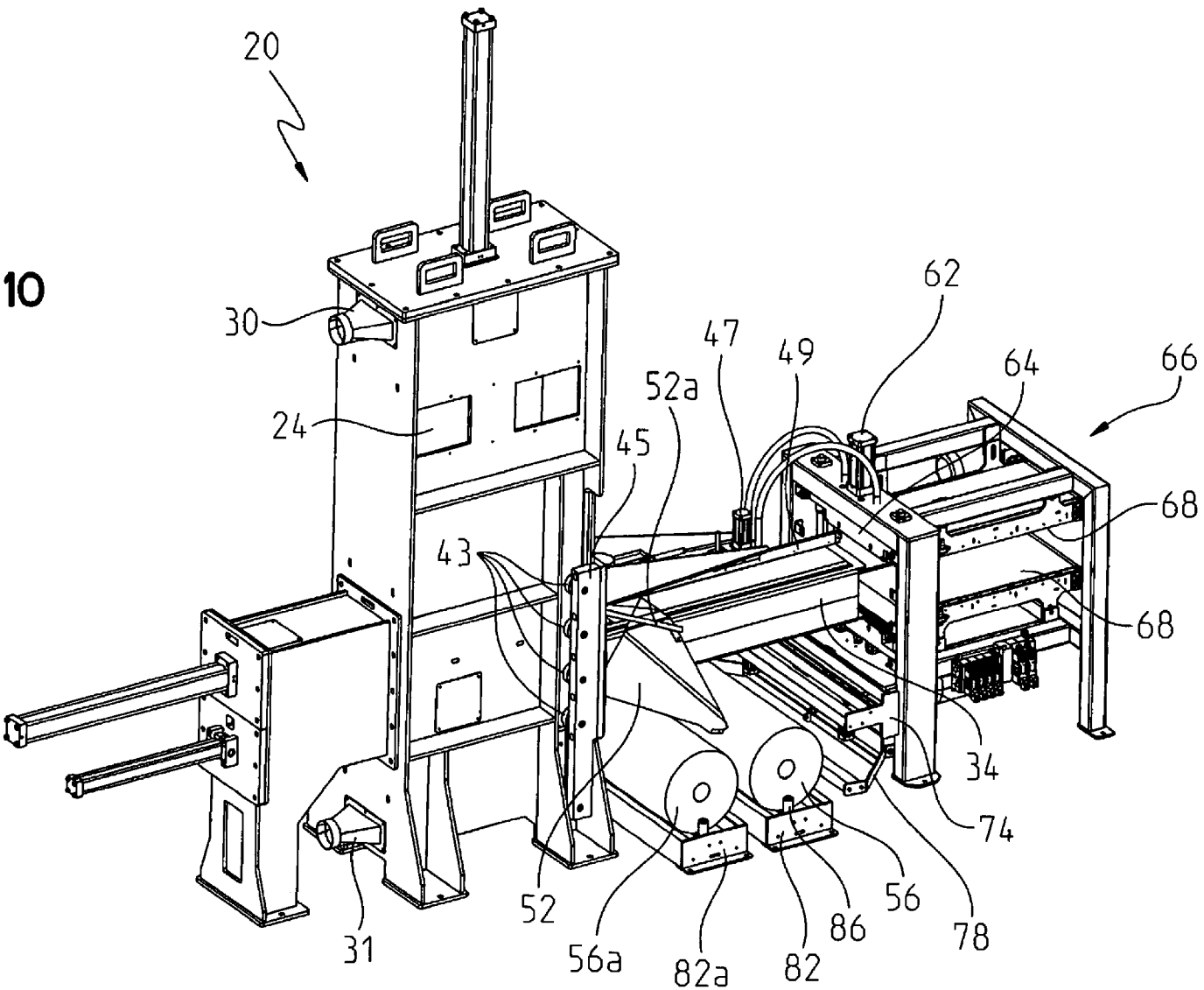
FIG. 10 is another perspective view of the apparatus.
Figure 11:
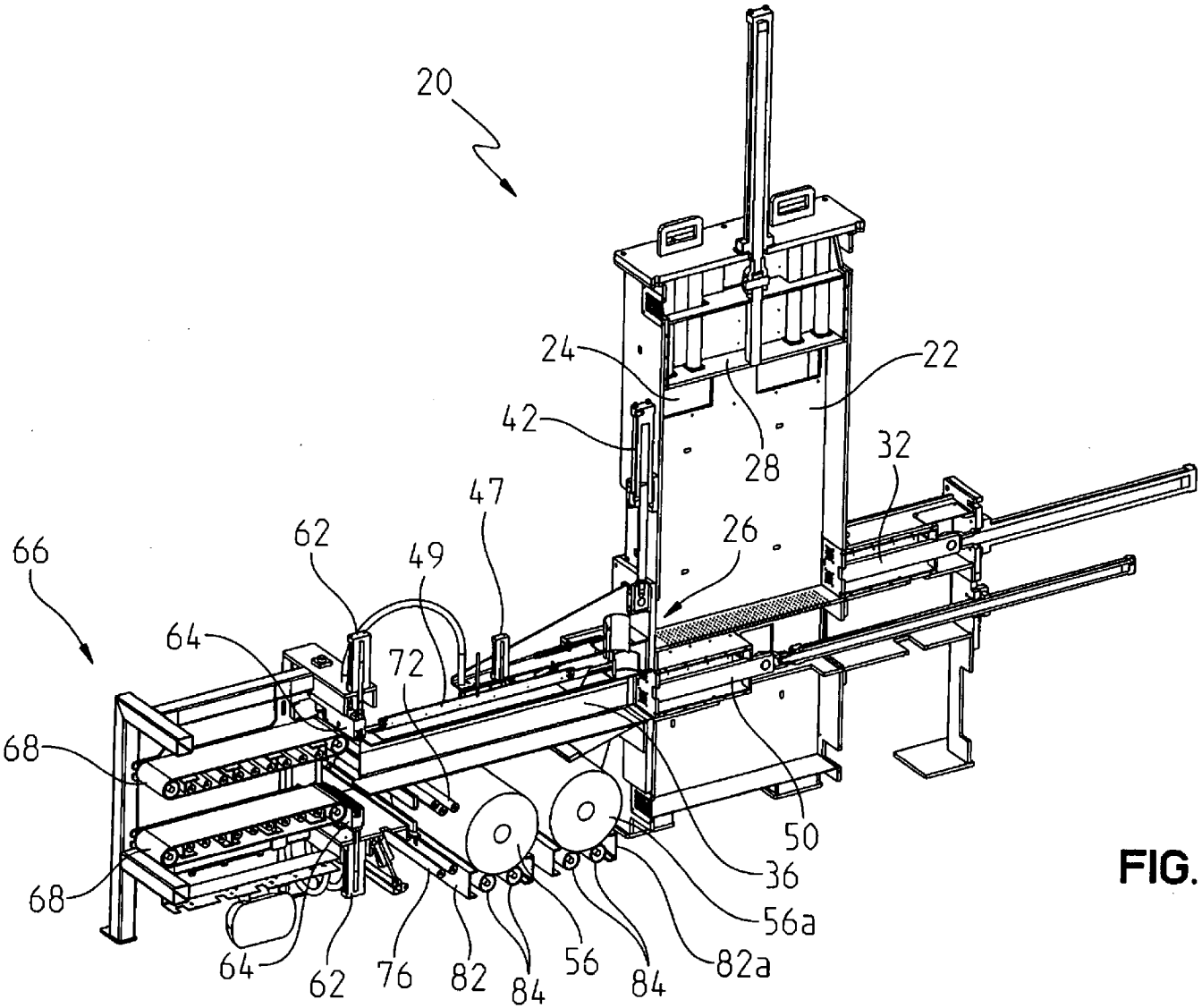
FIG. 11 is a cross sectional perspective view taken along line 11-11 of FIG. 9.

Apparatus 20 includes a compression chamber 22 having a conventional sheet steel construction. As seen in FIGS. 10 and 11, compression chamber 22 includes an inlet port 24 through which material is input into compression chamber 22 and an outlet port 26 through which the material is discharged. A compression ram 28 is mounted within compression chamber 22 and reciprocates in a vertical direction. In the illustrated embodiment, compression ram 28 is hydraulically powered and is moved between a fill position 28*a* and a compress position 28*b*. Compression ram 28 is in the fill position 28*a* in FIGS. 1, 7 and 8 and in the compress position 28*b* in FIGS. 2-5. The cyclic operation of apparatus 20 is discussed in greater detail below with reference to FIGS. 1-8.

Vent structure 30 provides communication between the surrounding environment and compression chamber 26 on the side of compression ram 28 opposite the material being compressed. In the illustrated embodiment, compression ram 28 moves vertically and vent 30 is in communication with that portion of compression chamber 22 that is located above compression ram 28 to allow the air pressure within compression chamber 22 above compression ram 28 to remain at the ambient air pressure.

A discharge ram 32 is also located within compression chamber 22. In the illustrated embodiment discharge ram 32 is a hydraulically powered ram that moves in a horizontal reciprocal motion. Discharge ram 32 moves between an initial position 32*a* spaced away from outlet port 26 and a discharge position 32*b* proximate the outlet port 26. Discharge ram 32 is in its initial position in FIGS. 1, 2, 7 and 8 and in its discharge position in FIG. 5. Discharge ram 32 is located between these two positions in FIGS. 3, 4 and 6. As discussed in greater detail below, after compression ram 28 has compressed material 10 into a portion 22*a* of compression chamber 22 proximate outlet port 26, discharge ram 32 is moved from its initial position 32*a* to its discharge position 32*b* and thereby discharges material 10 through outlet port 26.

Figure 4:
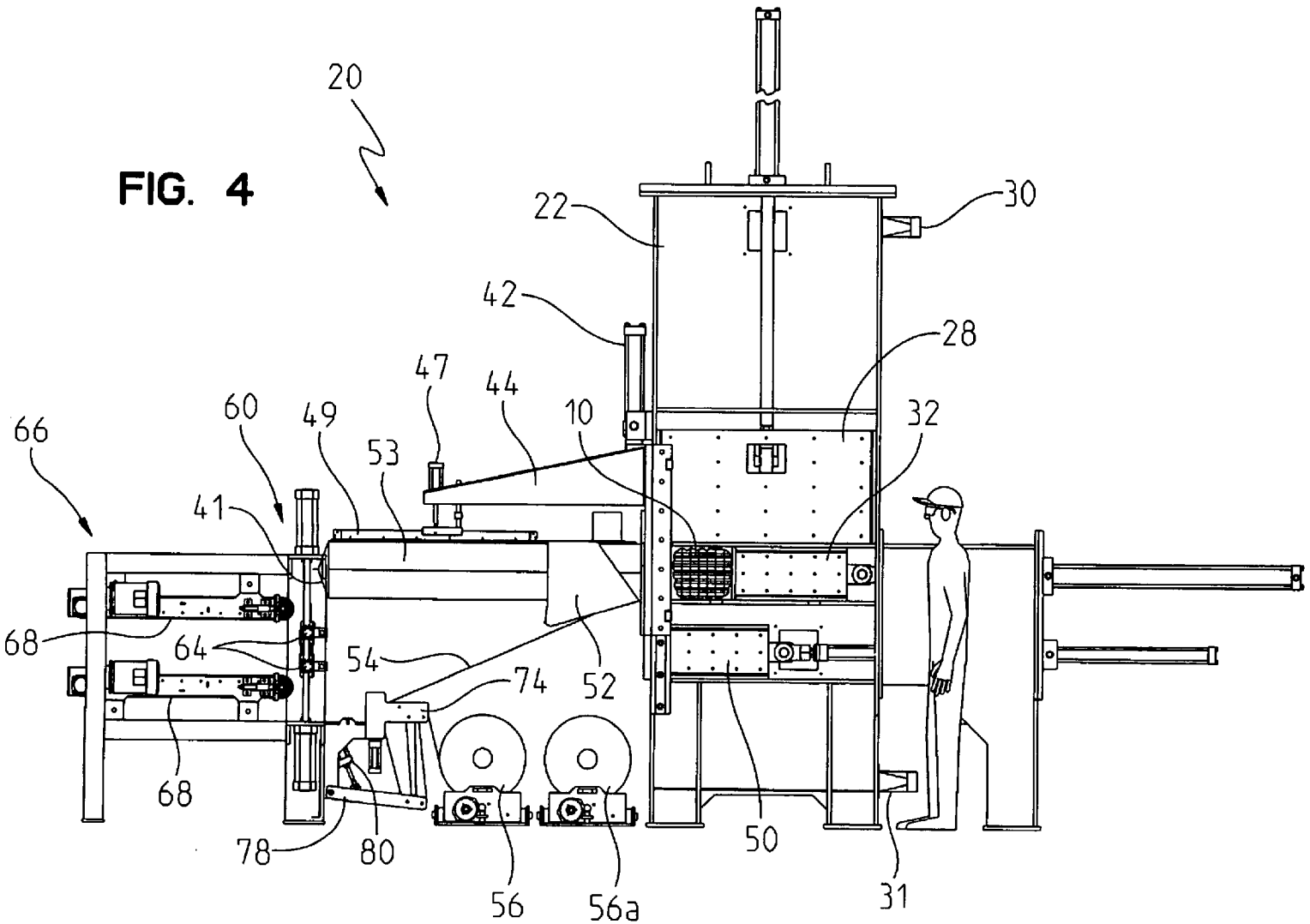
FIG. 4 is a schematic view illustrating the apparatus at a fourth point in the compression cycle.
Figure 5:
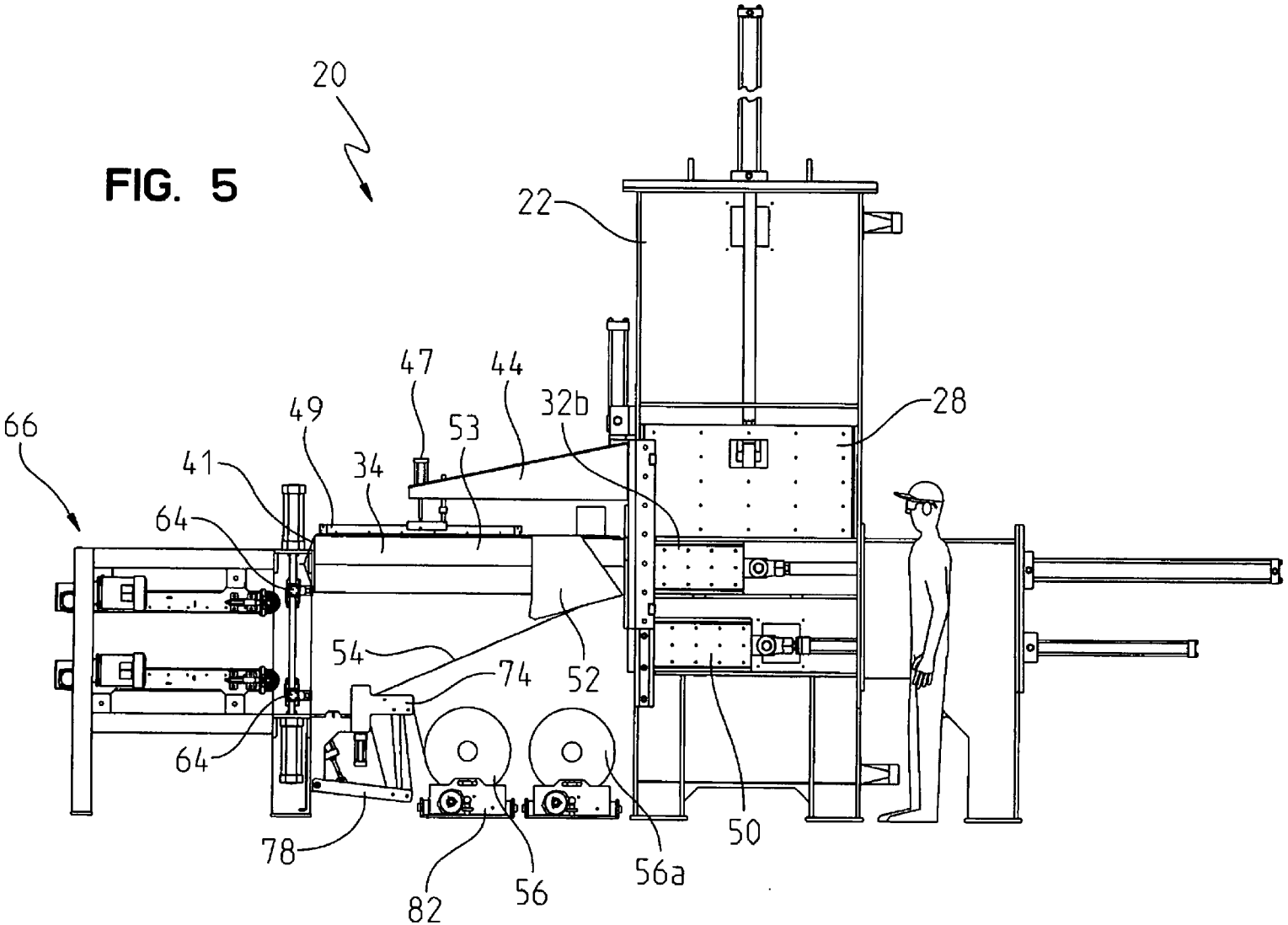
FIG. 5 is a schematic view illustrating the apparatus at a fifth point in the compression cycle.

A packaging receptacle 34 is positioned proximate outlet port 26 when material 10 is being discharged to receive the material 10 discharged through outlet port 26 by action of discharge ram 32. In the illustrated embodiment, receptacle 34 is a steel tube having a generally rectangular cross section that defines an inner volume 36. Opposing ends of receptacle 34 define openings 38, 40 which are in communication with inner volume 36. When receptacle is positioned as shown in FIGS. 4 and 5, opening 38 is positioned adjacent outlet 26 and the material 10 discharged from compression chamber 22 is received into inner volume 36. Material 10 is subsequently ejected from inner volume 36 through the opposite opening 40.

Figure 7:
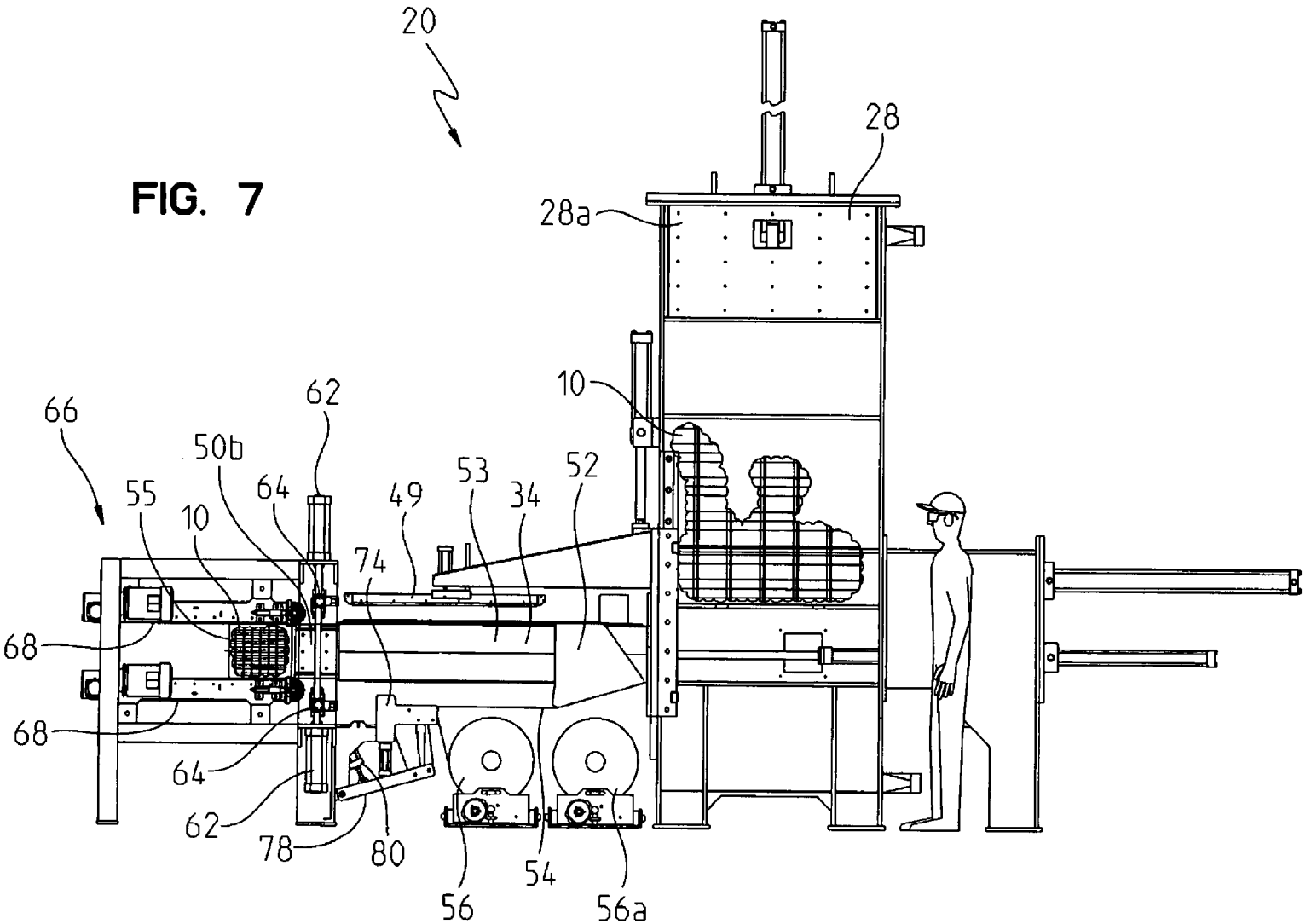
FIG. 7 is a schematic view illustrating the apparatus at a seventh point in the compression cycle.
Figure 8:
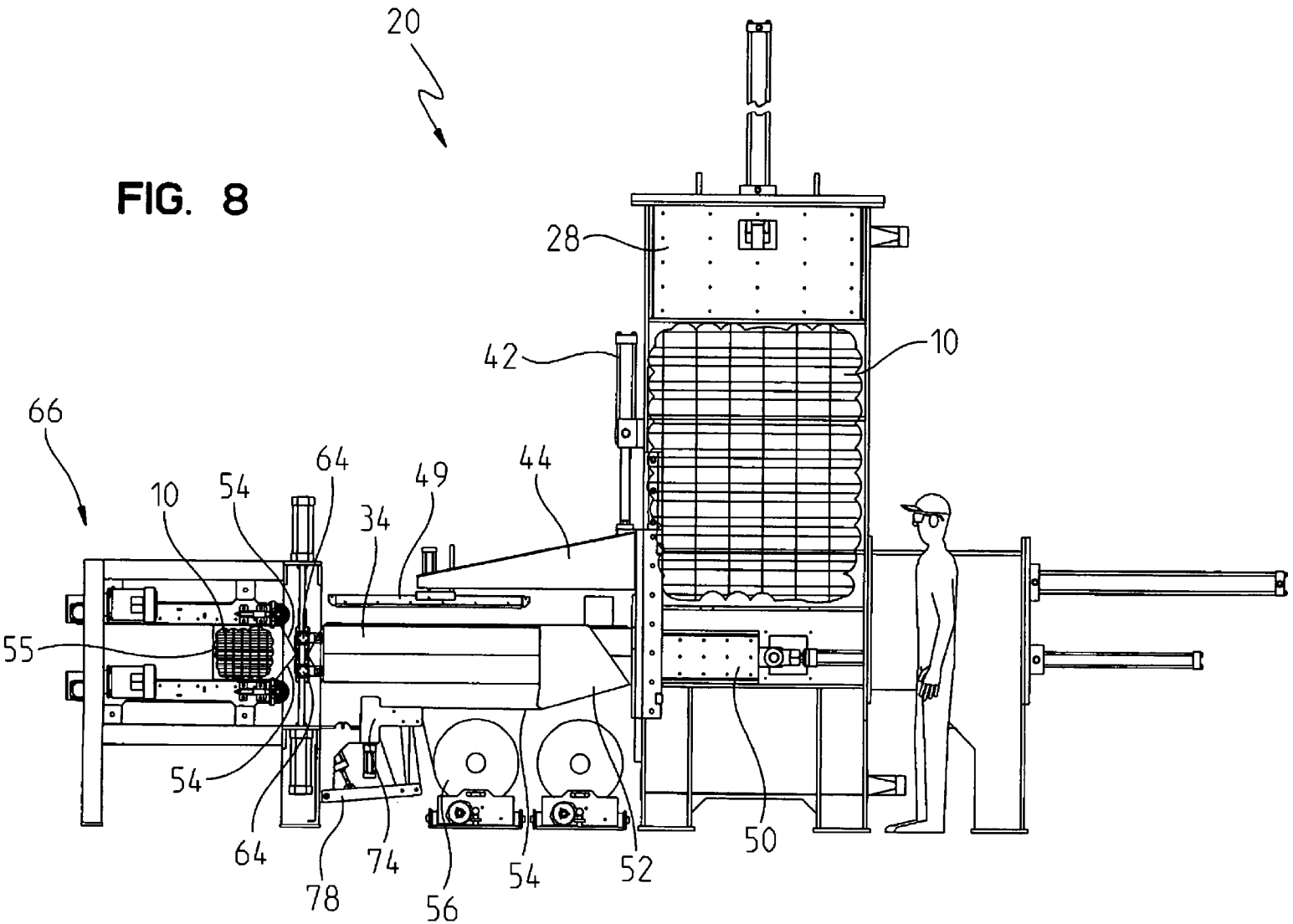
FIG. 8 is a schematic view illustrating the apparatus at an eight point in the compression cycle.
Figure 9:
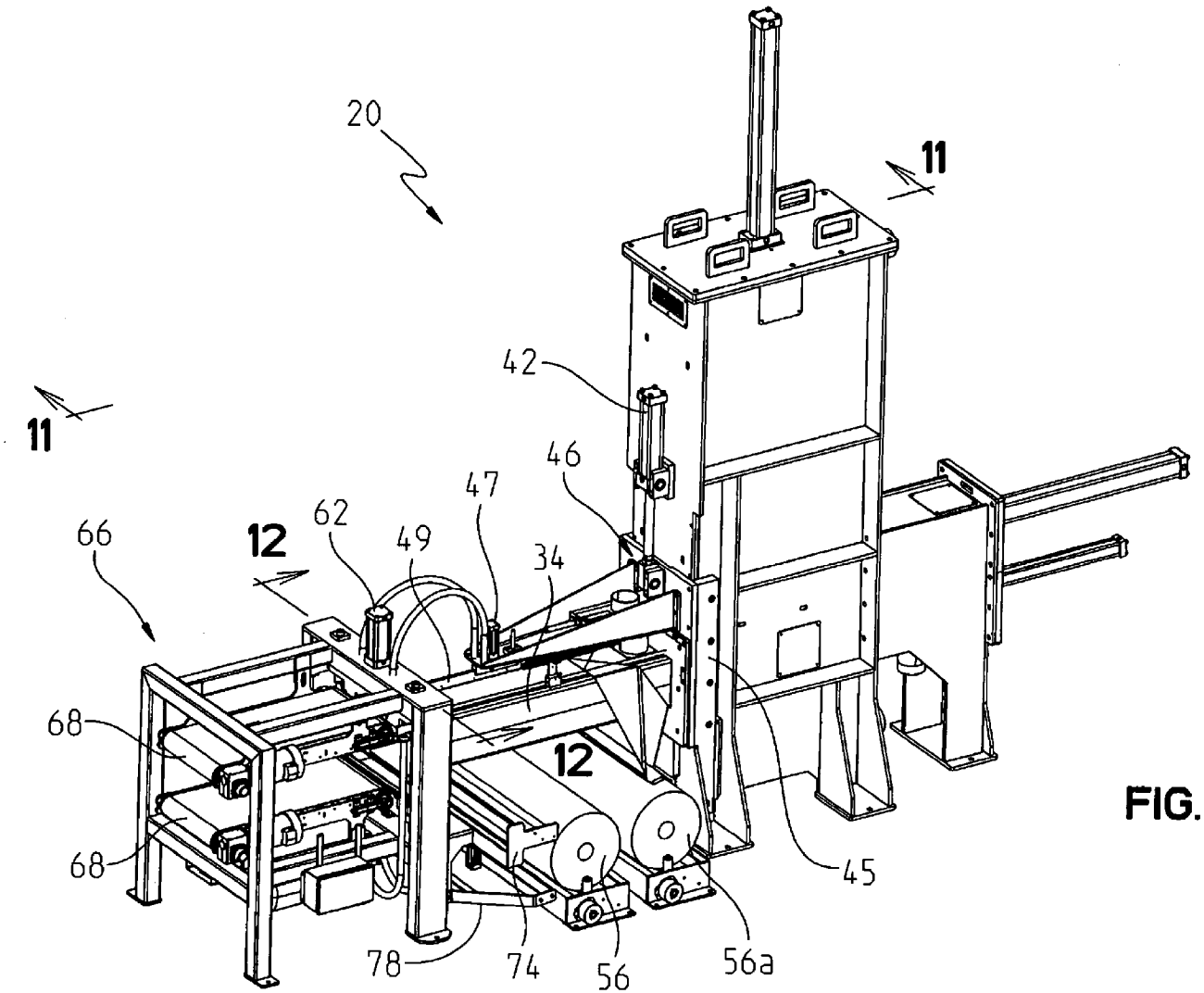
FIG. 9 is a perspective view of the apparatus.
Figure 12:
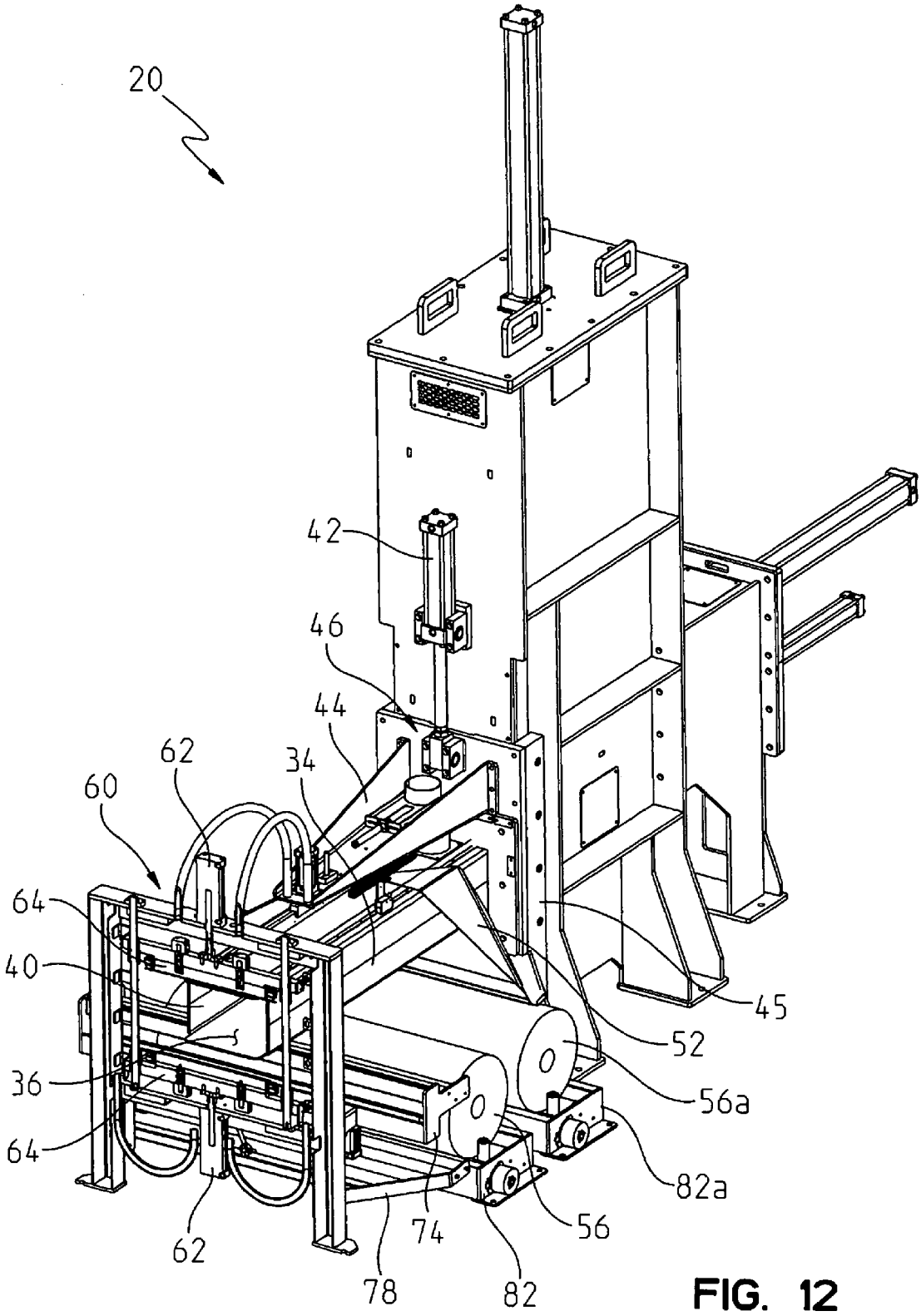
FIG. 12 is a cross sectional perspective view taken along line 12-12 of FIG. 9.

A vertically oriented hydraulic cylinder 42 moves receptacle 34 between a position proximate outlet 26 (FIGS. 4 and 5) and a position proximate ejection ram 50 (FIGS. 1-3 and 6-12). A gusset assembly 44 is fixed to and moves with receptacle 34. Gusset assembly 44 includes a stop plate 46 that covers outlet port 26 and prevents material 10 from spilling out of compression chamber 22 when opening 38 of receptacle 34 is not positioned adjacent outlet port 26. As seen in FIGS. 9, 10 and 12, stop plate 46 has side flanges 45 with rollers 43 that moveably secure stop plate 46 to apparatus 20 and allow stop plate 46 along with gusset assembly 44 and receptacle 34 attached thereto to move vertically with respect to compression chamber 22.

An elongate thermal sealing device 48 is also mounted on gusset assembly 44. Elongate thermal sealing member 49 is raised and lowered relative to receptacle 34 by hydraulic cylinder 47. Sealing member 49 is shown in a raised position in FIGS. 1 and 6-8 and in a lowered position in FIGS. 2-5. When in a raised position, sealing member 49 allows for the movement of plastic material along the exterior of receptacle 34. When in the lowered position, sealing member 49 presses overlapping portions of the plastic film against thermal plate 49*a* (FIG. 13) located on the upper surface of receptacle 34 and extending the length of sealing member 49. When sealing member 49 is lowered and sealing members 49 and 49*a* are heated, the sealing members 49, 49*a* will thermally join together the overlapping portions of the plastic film compressed between the two members 49, 49*a* to form a longitudinal seam 54*a*. The use of such thermal sealing members to join together plastic film is well known to those having ordinary skill in the art.

Figure 13:
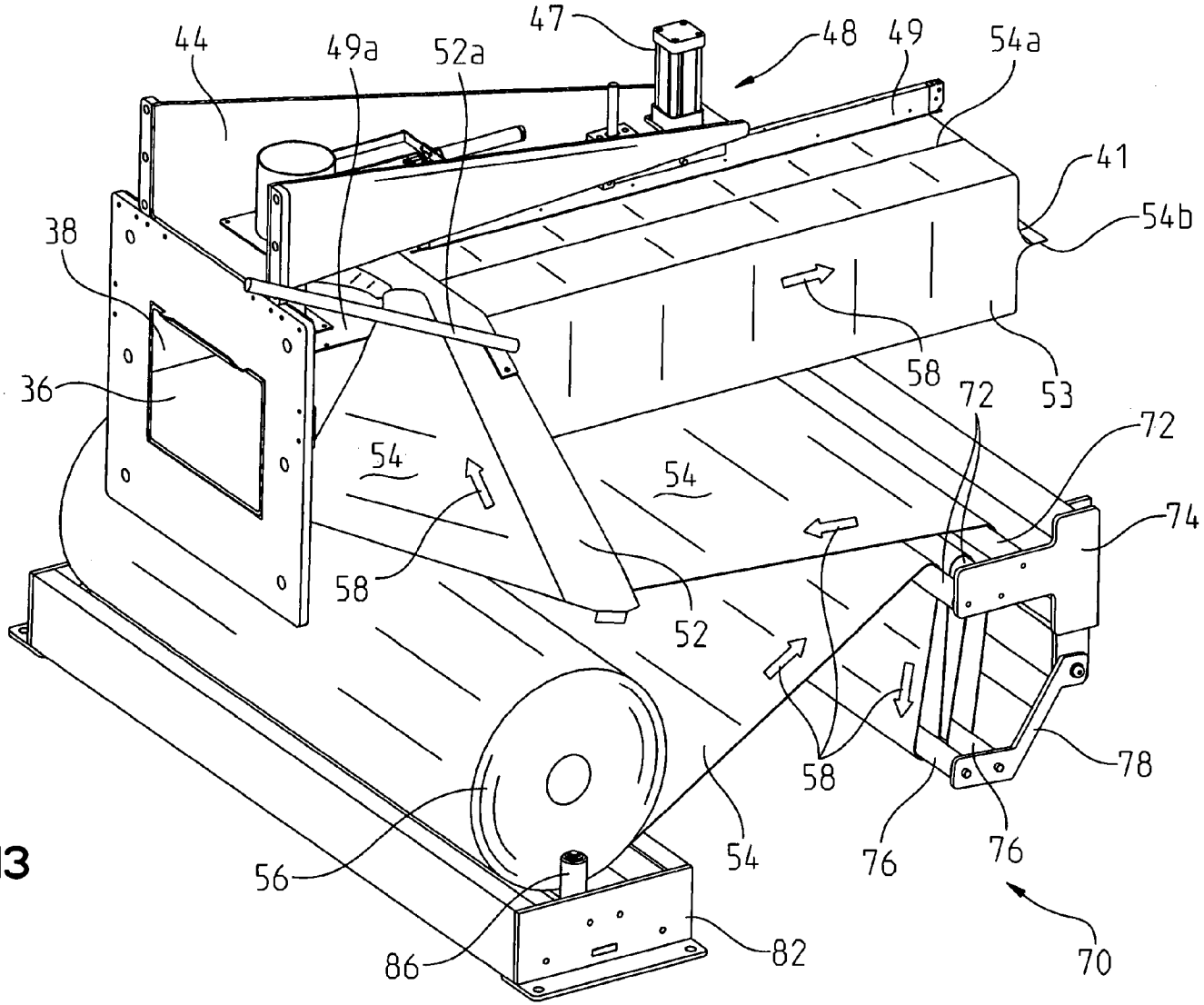
FIG. 13 is a perspective view of the dispensing mechanism for dispensing plastic film.

A folding hood 52 is also fixed to receptacle 34 and is used to guide and fold plastic film 54 from roll 56 about receptacle 34 to form a sleeve surrounding receptacle 34. Thermal sealing device 48 is used to join the opposite edges of the film 54 and thereby form plastic film 54 into a sleeve that fully surrounds receptacle 34. Bracket members 52*a* (FIG. 13) are used to support folding hood 52. Bracket members 52*a* are used on each side of hood 52 to support hood 52. Bracket members 52*a* are not shown in FIGS. 1-9, 11 and 12 for purposes of graphical clarity and FIGS. 10 and 13 illustrate one of the bracket members 52*a*. Bracket members 52*a* are attached at one end to stop plate 46 and are attached at their other end to the edge of folding hood 52 opposite stop plate 46. At least a portion of the edge of folding hood 52 proximate stop plate 46 is spaced from stop plate 46 to allow for the travel of film 54 between hood 52 and stop plate 46.

In the illustrated embodiment, ejection ram 50 is positioned parallel with and below discharge ram 32. When cylinder 42 lowers receptacle 34 to the position shown in FIGS. 1-3 and 6-8, receptacle 34 is in a position that allows ejection ram 50 to enter inner volume 36 through opening 38 and thereby eject any material 10 from inner volume 36 through opposite opening 40. Ejection ram 50 is reciprocally moved between a return position 50*a* (FIGS. 1-6 and 8) and an ejection position 50*b* (FIG. 7). In other words, with receptacle 34 positioned adjacent ram 50, reciprocal movement of ejection ram 50 between the return and ejection positions 50*a*, 50*b* alternatively extends and retracts ejection ram 50 into and from inner volume 36 through opening 38. A vent structure 31 is positioned below ejection ram 50 and allows for the equalization of air pressure within apparatus 20 as ejection ram 50 is projected out of apparatus 20 to the ejection position 50*b* and retracted into apparatus 20 to the return position 50*a*.

It is noted that while the illustrated embodiment employs a hydraulic system for driving rams 28, 32 and 50 and various other features of apparatus 20, various other known driving means, such as a pneumatic system or servo motors, may alternatively be employed with one or more of these rams and the other hydraulically powered features of apparatus 20.

When ejection ram 50 is projected into inner volume 36, it ejects the material 10 located within inner volume 36 out of volume 36 through opening 40. As the material 10 is ejected, it engages the closed end 41 of the plastic film sleeve 53 that surrounds receptacle 34 and thereby inserts the material 10 into sleeve 53 and simultaneously draws additional plastic film 54 about receptacle 34 to replace the film sleeve 53 into which the material 10 has been deposited. The film sleeve thereby forms a packaging jacket 55 within which material 10 is confined after it has been ejected from inner volume 36.

After material 10 has been ejected into packaging jacket 55, a sealing apparatus 60 is used to seal the open end of the packaging jacket 55. The open end of the packaging jacket 55 will be located proximate opening 40 after material 10 has been ejected from inner volume 36. Sealing apparatus 60 is mounted between packaging jacket 34 and conveyer system 66. FIG. 12 is a perspective cross sectional view where the cross section has been taken through the midpoint of sealing apparatus 60. As can be seen in FIG. 12, sealing apparatus 60 includes vertically oriented upper and lower hydraulic cylinders 62. Attached to hydraulic cylinders 62 are two horizontally extending elongate thermal sealing members 64.

In FIG. 12, sealing members 64 are spaced apart by a sufficient amount to allow material 10 to be ejected from inner volume 36 into film sleeve 53 and to pass between the two sealing members 64. After material 10 has been ejected from inner volume 36 and is gripped between the two conveyor tracks 68 of conveyor system 66, the film sleeve 53 which surrounds the material 10 will still be continuous with the plastic film located on receptacle 34. Hydraulic cylinders 62 will then be extended so that sealing members 64 pinch the plastic sleeve 53 together between material 10 and opening 40 of receptacle 34. The sealing members 64 will then thermally join the plastic film squeezed between the two sealing members 64 and simultaneously separate the plastic film forming packaging jacket 55 that encircles material 10 from the plastic film that is still located on receptacle 34. Sealing members 64 join together the plastic film on each side of the separated film so that the material 10 within the packaging jacket 55 is now fully sealed within the packaging jacket and the end of sleeve 53 located on receptacle 34 at opening 40 along end seam 54*b* (FIG. 13) to thereby form a closed end 41. The use of a thermally sealing apparatus to simultaneously join and sever plastic film in this manner is well known to those having ordinary skill in the art.

After packaging jacket 55 is fully sealed and separated from the remaining plastic film 54 located on receptacle 34, the material 10 located in packaging jacket 55 is then conveyed away from apparatus 20 by conveyor system 66. For example, the filled packaging jacket 55 may be conveyed to a location where it is stacked on a pallet or otherwise prepared for shipping.

Apparatus 20 also includes a dispensing mechanism 70 for regulating the dispensing of plastic film 54. Mechanism 70 includes an upper set of rollers 72 mounted on fixed bracket 74 and a lower set of rollers 76 mounted on pivotal lower bracket 78 which is moved by hydraulic cylinder 80. Film roll 56 is located within carrier 82 which includes two elongate parallel horizontal rollers 84 on which film roll 56 rests. Carrier 82 also includes two vertically oriented rollers 86 which limit longitudinal movement of film roll 56. When plastic film 54 is pulled, rollers 84 allow film roll 56 to rotate and thereby dispense plastic film 54. FIGS. 1-8 illustrate a second carrier 82*a* and film roll 56*a* which will be used after the first film roll 56 has been depleted.

Plastic film 54 is routed from film roll 56 in serial order about an upper roller 72, a lower roller 76, an upper roller 72, a lower roller 76 and then another upper roller 72 before engaging folding hood 52. By raising and lowering the lower bracket 78 with hydraulic cylinder 80, the distance between the upper and lower rollers 72, 76 can be reduced (by raising lower bracket 78) or increased (by lower bracket 78) and thereby either reduce or increase the length of the plastic film 54 that is wrapped about and extends between these two sets of rollers. When apparatus 20 is operating, lower bracket 78 will be moved from its lower position to it upper position immediately before or simultaneously with the ejection of material 10 from inner volume 36. By raising bracket 78, slack is introduced into the film 54 between roller 56 and folding hood 52 to thereby allow this film to more easily be advanced onto receptacle 34 as film previously located on receptacle 34 is used to form a packaging jacket 55 for receiving the ejected material 10. After the plastic film 54 has been advanced onto receptacle 34, the lower bracket 78 is then lowered. This lowering of bracket 78 pulls additional plastic film from roll 56 to thereby complete the film dispensing cycle. Directional arrows 58 (FIG. 13) illustrate the direction in which film 54 moves when plastic film 54 is advanced due to the ejection of compressed material 10 from receptacle 34.

Turning now to the cyclic operation of apparatus 20, FIGS. 1-8 will be discussed following a particular batch of material 10 through apparatus 20. In the illustrated embodiment, material 10 is a loose compressible material. Examples of such loose compressible material that can be packaged by apparatus 20 include fiberglass insulation, cellulose insulation, rockwool insulation, hydroseed mulch, wood shavings, and straw. The present invention is not, however, limited to use with these exemplar materials and various other materials may also be packaged using the present invention. Material 10 is input into compression chamber 22 through inlet port 24. A conventional auger (not shown) can be used to feed material 10 into chamber 22. Advantageously, a pre-weigh auger that inputs a known weight of material 10 for each packaging cycle is used with apparatus 20. For free flowing materials a dump chute instead of auger may be used to input material into chamber 22.

Compression ram 28 is moved to its fill position 28*a* and discharge ram 32 is moved to its initial position 32*a* before inputting the material 10 into chamber 22. FIG. 1 schematically depicts apparatus 20 after the inputting of the desired quantity of compressible material 10 into chamber 22 has just been completed. Compression ram 28 and discharge ram 32 are still in their fill and initial positions and material 10 has not yet been compressed. As can also be seen in FIG. 1, receptacle 34 is in its ejection position proximate ejection ram 50 instead of its fill position adjacent outlet port 26. At this point in the cycle (FIG. 1), the last batch of material 10 has been packaged and a new section of plastic film 54 has just been drawn onto receptacle 34 and has not yet been sealed by elongate sealing device 48. Elongate sealing member 49 is still in its raised position which allows plastic film 54 to be drawn onto receptacle 34. Lower bracket 78 is in its upper position and ejection ram 50 has been retracted to its return position 50*a*.

Figure 2:
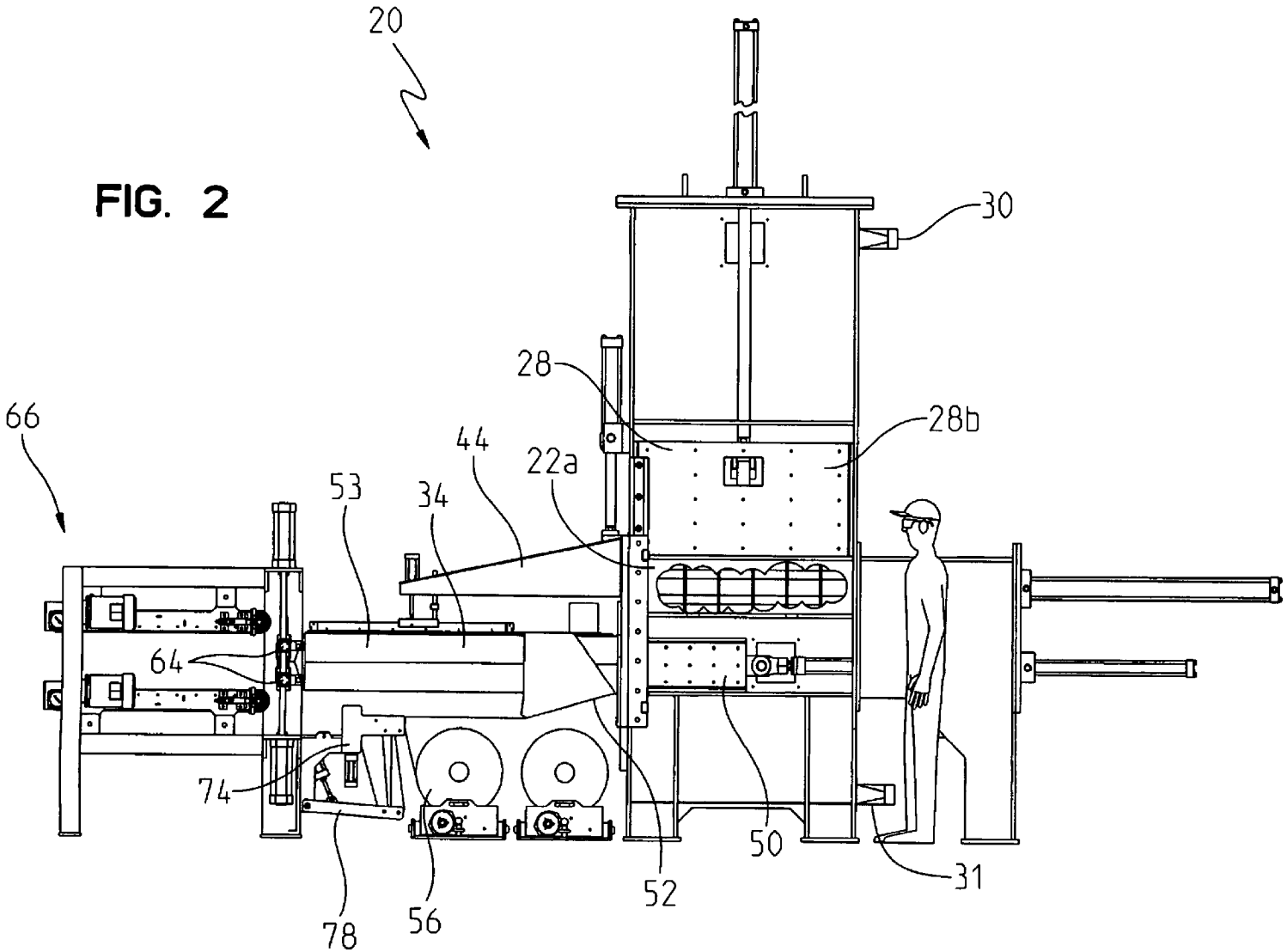
FIG. 2 is a schematic view illustrating the apparatus at a second point in the compression cycle.

Turning now to FIG. 2, compression ram 28 has been moved to its compress position and in the process has compressed material 10 into a portion 22*a* of chamber 22 which is proximate outlet port 26. The material 10 within chamber 22 has now been partially compressed and lies between outlet port 26 and discharge ram 32. Discharge ram 32 is still in its initial position. Cylinder 47 has lowered elongate sealing member 49 to engage the overlapping plastic film edges located between sealing members 49, 49*a* of sealing device 48. Sealing members 49, 49*a* are then heated to join the overlapping plastic film layers in a longitudinal seam 54*a* and form a cylindrical sleeve 53 with a closed end 41 (adjacent opening 40) about receptacle 34. After sealing member 49 has completed the joining of the film layers, it is no longer heated but still continues to engage film 54 against receptacle 34. With the newly sealed film 54 being held securely against receptacle 34 by sealing member 49, lower bracket 78 is lowered drawing additional film 54 from roll 56. Receptacle 34 remains in its lower ejection position adjacent ejection ram 50 in FIG. 2. In the illustrated embodiment, film roll 56 is a heat sealable polyethylene flat film roll with film 54 having a thickness between 1 and 6 mils. Various other types and thicknesses of films, however, may also be used with the present invention.

Figure 3:
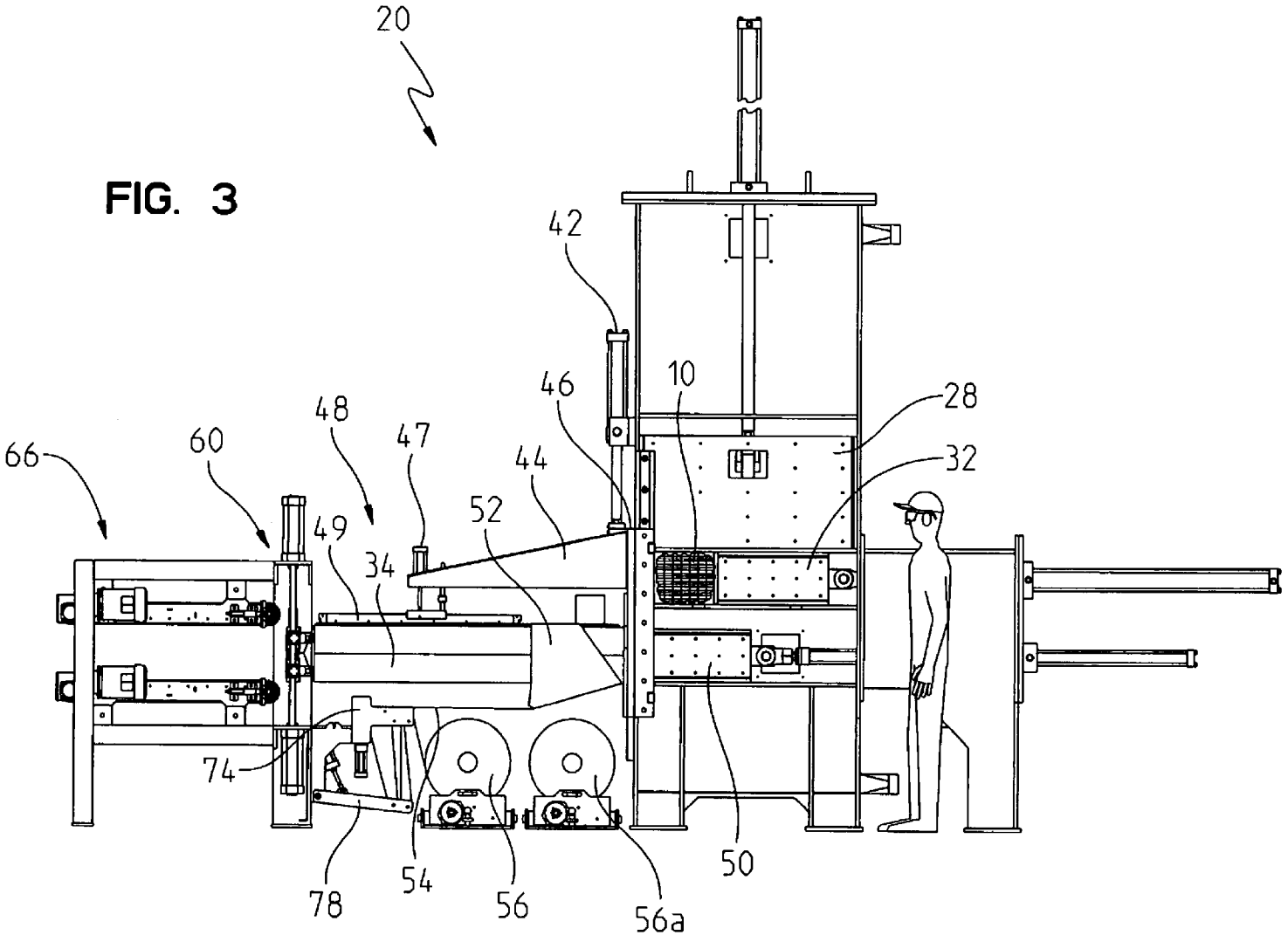
FIG. 3 is a schematic view illustrating the apparatus at a third point in the compression cycle.

Turning now to FIG. 3, receptacle 34 remains in its ejection position with stop plate 46 positioned to block the expulsion of material 10 through outlet port 26. Discharge ram 32 has been advanced part of the way toward outlet port 26 further compressing material 10. In this position, material 10 has been over-compressed to a size that is smaller than the final size of material 10 within packaging jacket 55 and the forward advance of discharge ram 32 is halted.

Turning now to FIG. 4, receptacle 34 is moved to its fill position with opening 38 of receptacle 34 being aligned with outlet port 26. The raising of receptacle 34 also raises stop plate 46 so that it no longer blocks the expulsion of material 10 through outlet port 26. Raised together with receptacle 34 are folding hood 52 and the plastic film 54 that is engaged with hood 52 and receptacle 34. As a result, lower bracket 78 may rise slightly to release a small length of film 54 to account for the raising of receptacle 34.

Turning now to FIG. 5, discharge ram 32 has been extended to its discharge position 32*b* and thereby pushed compressed material 10 through outlet port 26 into inner volume 36. Advantageously, discharge ram 32 extends no further than is necessary to dispose compressed material 10 fully within inner volume 36. After compressed material 10 has been pushed into inner volume 36, the movement of discharge ram 32 is reversed and ram 32 is returned to its initial position 32*a*. The movement of compression ram 28 to its fill position 28*a* and the lowering of receptacle 34 also begin after the placement of compressed material 10 within inner volume 36 has been completed.

With reference to both FIGS. 4 and 5, it can be seen that after raising receptacle 34, sealing members 64 are returned to their separated positions to allow for the pushing of a compressed batch of material 10 between members 64. Although this separation of members 64 takes place shortly after raising receptacle 34 in the illustrated embodiment, it may take place anytime in the production cycle between the sealing of the previous packaging jacket 55 and the ejection of the next batch of compressed material 10 from inner volume 36.

Figure 6:
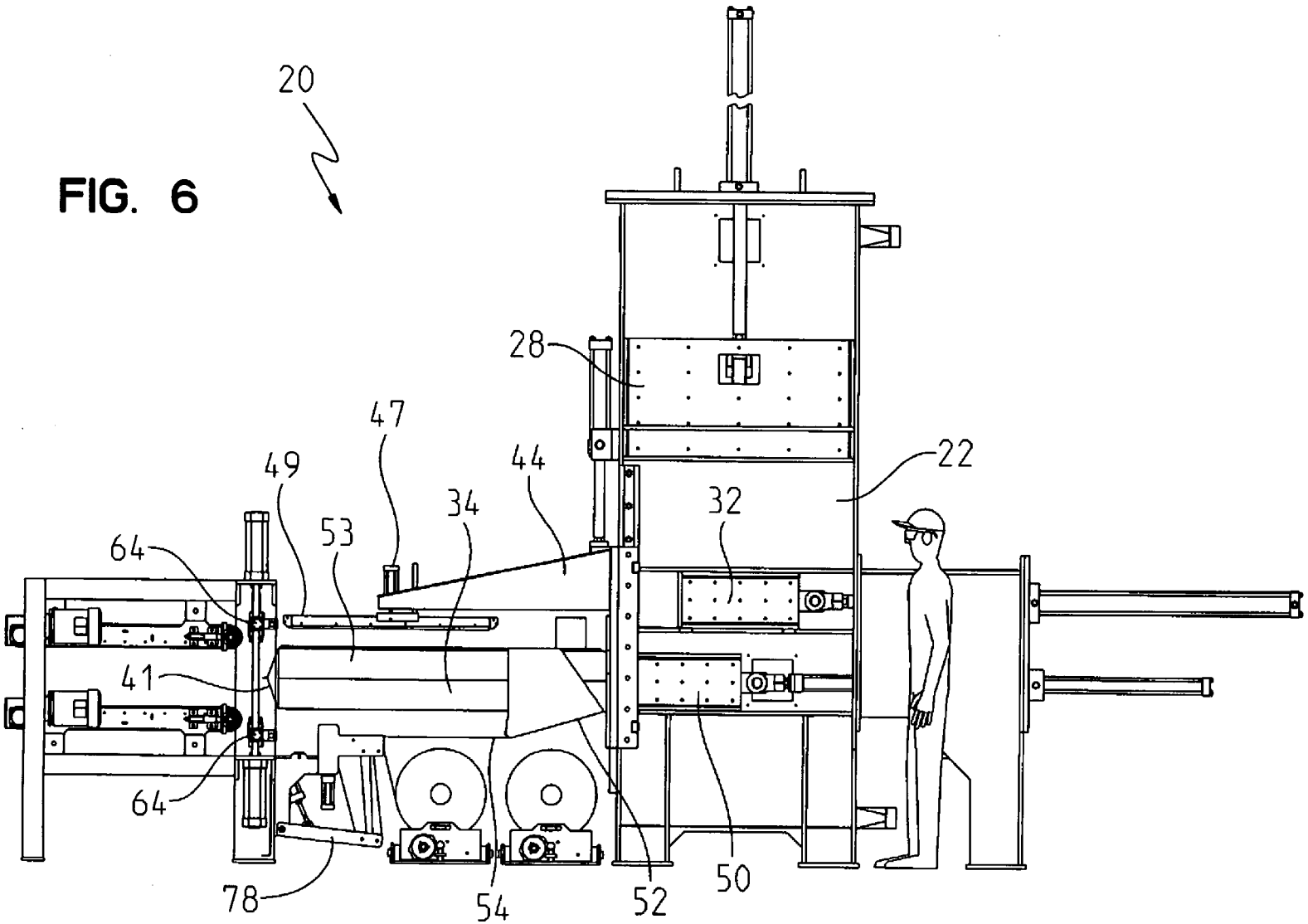
FIG. 6 is a schematic view illustrating the apparatus at sixth point in the compression cycle.

FIG. 6 illustrates that point in the cycle when compression ram 28 is still moving towards its fill position 28*a*, discharge ram 32 is still moving towards initial position 32*a*, and receptacle 34 has just reached its ejection position adjacent ejection ram 50. After receptacle 34 reaches the position shown in FIG. 6, the advancement of ejection ram 50 into inner volume 36 is initiated. After discharge ram 32 and compression ram 28 complete their return movements to their respective initial and fill positions 32*a*, 28*a*, the input of a new batch of material 10 into chamber 22 is initiated. As can also be seen in FIG. 6, elongate sealing member 49 is raised into a position where it no longer bears against film 54 disposed about receptacle 34 after receptacle 34 has been moved to its ejection position. In its raised position, elongate sealing member 49 will not interfere with the advance of film along receptacle 34 during the ejection of material 10 from receptacle 34.

FIG. 7 illustrates the point in the cycle where at least some of the next batch of material 10 has already been input into chamber 22 and ejection ram 50 has been fully extended to its ejection position 50*b* and pushed compressed material 10 out of inner volume 36. As compressed material 10 is pushed out of inner volume 36 it engages the closed end of plastic sleeve 53 that spans across opening 40 of receptacle 34 and as material 10 is inserted into sleeve 53 it also pulls sleeve 53 off of receptacle 34. Lower bracket 76 has been pivoted upwards to allow an equivalent length of film 54 to advance from in between rollers 72, 76 toward and around folding hood 52 onto receptacle 34. It is also noted that ejection ram 50 extends out of inner volume 36 through opening 40 by a length adequate to advance a sufficient quantity of film 54 to cover the surface of compressed material 10 that is in contact with ejection ram 50. It is also noted that sealing member 49 is in its raised position spaced from the plastic film 54 on receptacle 34 while plastic film 54 is in movement on receptacle 34 due to the ejection of compressed material 10 by ram 50. After ram 50 has advanced to the position shown in FIG. 7 and thereby fully ejected compressed material 10 from inner volume 36, its movement is reversed and ram 50 is moved to its return position 50*a*.

FIG. 8 illustrates the point in the cycle at which ejection ram 50 has just been returned to its return position 50*a*. The next batch of material 10 has been fully input into chamber 22 and the advancement of compression ram 28 is being initiated to compress this next batch of material 10. Thermal sealing members 64 of sealing apparatus 60 have been advanced to pinch opposing layers of sleeve 53 together and thermally seal the layers together and thereby fully enclose compressed material 10 within a packaging jacket 55. Sealing apparatus 60 also separates the packaging jacket 55 enclosing compressed material 10 from the film 54 remaining on receptacle 34. Sealing members seal the opposed film layers of sleeve 53 together on both sides of the separation and thus also form an end seam 54*b* and closed sleeve end 41 that spans opening 40 of receptacle. The use of a sealing apparatus 60 to separate a tubular sleeve of plastic film and simultaneously join together the two parted ends of the sleeve will be readily understood by those having ordinary skill in the art. After film 54 has been sealed to form a closed end 41 spanning opening 40 and the closed end 41 prevents film 54 located on receptacle 34 from being pulled back toward folding hood 52, lower bracket 76 can be pivoted downwards to pull additional film 54 from roll 56.

The compressed material 10 enclosed within packaging jacket 55 is then transported away from receptacle 34 by conveyor system 66 and the cycle is repeated as described herein above and shown in FIGS. 1-8.

By separating the operation of the discharge ram 32 from that of the ejection ram 50, the initiation of the next compression and bagging cycle does not have to wait for the compressed material 10 to be fully ejected from receptacle 34 and for the ram performing the ejection to be returned to its initial position before a new batch of material is input into compression chamber 22 as would be required if receptacle 34 did not move and ram 32 both injected material 10 into receptacle 34 and ejected material 10 out of receptacle 34 into a product jacket 55. Thus, by providing a moveable receptacle 34 and an ejection ram 50 to perform the "bagging" operation, rams 32 and 28 can return to their fill and initial positions and the input of the next batch of material 10 can begin while ejection ram 50 is still extended. This separation of the compression/product discharge operation from the bagging operation advantageously allows for an increased production rate.

While this invention has been described as having an exemplary design, the present invention may be further modified within the spirit and scope of this disclosure. This application is therefore intended to cover any variations, uses, or adaptations of the invention using its general principles.

What is claimed is:

1. An apparatus for compressing a loose material, said apparatus comprising:

a compression chamber having an inlet port and an outlet port wherein the loose material is received into said compression chamber through said inlet port and discharged from said compression chamber through said outlet port;

a first ram, operable movement of said first ram discharging the loose material in a compressed state through said outlet port;

a second ram;

a packaging receptacle defining an inner volume, said packaging receptacle being moveable between a first position wherein said packaging receptacle is positioned proximate said outlet port and said inner volume is positioned to receive the compressed material discharged through said outlet port by said first ram and a second position wherein said packaging receptacle is positioned proximate said second ram and movement of said second ram ejects the compressed material disposed within said inner volume from said inner volume; and, wherein said inner volume has first and second opposed openings and the compressed material is received from said outlet port into said inner volume through said first opening and is ejected from said inner volume through said second opening.

2. The apparatus of claim 1 wherein the compressed material ejected from said inner volume by said second ram is received and confined within a packaging jacket.

3. The apparatus of claim 1 wherein said compression chamber further includes a compression ram reciprocally moveable between a fill position and a compress position and wherein said first ram reciprocally moves between an initial position and a discharge position; and said apparatus operates in a cyclic manner wherein, following the input of loose material into said compression chamber, said compression ram is moved from said fill position to said compress position and thereby compresses the loose material into a portion of said compression chamber proximate said outlet port and movement of said first ram from said initial position to said discharge position discharges the loose material through said outlet port and into said inner volume of said packaging receptacle in a compressed state;

following the discharge of the compressed material through said outlet port and entry of the compressed material into said inner volume, said packaging receptacle and said second ram perform a product ejection operation wherein said packaging receptacle is moved from said first position to said second position and said second ram is moved from a return position to an ejection position thereby ejecting the compressed material from said inner volume; and wherein prior to the completion of said product ejection operation by said packaging receptacle and said second ram, the movement of said first ram from said discharge position to said initial position and the movement of said compression ram from said compress position to said fill position is initiated.

4. The apparatus of claim 3 wherein reciprocal movement of said second ram between said return position and said ejection position alternatively extends and retracts said second ram into and from said inner volume; and wherein, during cyclic operation of said apparatus, said first ram is returned to said initial position and said compression ram is returned to said fill position and additional loose material is input into said compression chamber prior to said second rain being retracted from said inner volume.

5. An apparatus for compressing a loose material, said apparatus comprising:

a compression chamber having an inlet port and an outlet port wherein the loose material is received into said compression chamber through said inlet port and discharged from said compression chamber through said outlet port;

a first ram, operable movement of said first ram discharging the loose material in a compressed state through said outlet port;

a second ram;

a packaging receptacle defining an inner volume, said packaging receptacle being moveable between a first position wherein said packaging receptacle is positioned proximate said outlet port and said inner volume is positioned to receive the compressed material discharged through said outlet port by said first ram and a second position wherein said packaging receptacle is positioned proximate said second ram and movement of said second ram ejects the compressed material disposed within said inner volume from said inner volume:

wherein said inner volume has first and second opposed openings and the compressed material is received from said outlet port into said inner volume through said first opening and is ejected from said inner volume through said second opening; and wherein reciprocal movement of said second ram between a return position and an ejection position alternately extends and retracts said second ram into and from said inner volume through said first opening.

6. The apparatus of claim 5 further comprising a dispensing mechanism dispensing a plastic film, the dispensed plastic film forming a sleeve about the packaging receptacle and wherein the compressed material ejected from said inner volume by said second ram is received and confined within the plastic sleeve which thereby forms a packaging jacket.

7. The apparatus of claim 6 further comprising at least one sealing apparatus operable to thermally join the plastic film proximate the second opening wherein ejection of the compressed material from said inner volume engages the compressed material with the joined plastic film and thereby simultaneously disposes the compressed material within the plastic sleeve disposed about the packaging receptacle to thereby dispose the compressed material in a packaging jacket formed by the sleeve and draws additional plastic film from said dispensing mechanism about the packaging receptacle; said thermal joining of the plastic film proximate said second opening simultaneously separating the filled packaging jacket from the plastic sleeve remaining on the packaging receptacle.

8. The apparatus of claim 7 wherein said compression chamber further includes a compression. ram reciprocally moveable between a fill position and a compress position and wherein said first ram reciprocally moves between an initial position and a discharge position; and said apparatus operates in a cyclic manner wherein, following the input of loose material into said compression chamber, said compression ram is moved from said fill position to said compress position and thereby compresses the loose material into a portion of said compression chamber proximate said outlet port and movement of said first ram from said initial position to said discharge position discharges the loose material through said outlet port and into said inner volume of said packaging receptacle in a compressed state;

following the discharge of the compressed material through said outlet port and entry of the compressed material into said inner volume, said packaging receptacle and said second ram perform a product ejection operation wherein said packaging receptacle is moved from said first position to said second position and said second ram is moved from said return position to said ejection position thereby ejecting the compressed material from said inner volume; and wherein prior to the completion of said product ejection operation by said packaging receptacle and said second ram, the movement of said first ram from said discharge position to said initial position and the movement of said compression ram from said compress position to said fill position is initiated.

9. The apparatus of claim 8 wherein said first ram is returned to said initial position and said compression ram is returned to said fill position and additional loose material is input into said compression chamber prior to completion of said product ejection operation.

10. The apparatus of claim 8 wherein said first ram is returned to said initial position and said compression ram is returned to said fill position and additional loose material is input into said compression chamber prior to said second ram being retracted from said inner volume.

11. A method of compressing a compressible material, said method comprising:

inputting the compressible material into a compression chamber;

compressing the compressible material within the compression chamber;

providing a first ram moveable between an initial position and a discharge position;

providing a packaging receptacle moveable between a first position and a second position wherein the packaging receptacle defines an inner volume;

positioning the packaging receptacle in the first position and discharging the compressible material from the compression chamber in a compressed state and into the inner volume by movement of the first ram toward the discharge position;

moving the packaging receptacle from the first position to the second position with the compressed material disposed within the inner volume;

providing a second ram moveable between a return position and an ejection position;

ejecting the compressed material from the packaging receptacle by movement of the second ram toward the ejection position while the packaging receptacle is in the second position; and, wherein the inner volume has first and second opposed openings and the compressed material is received from the outlet port through the first opening and is ejected from the inner volume through the second opening.

12. The method of claim 11 further comprising:

returning the first ram to the initial position after discharging the compressible material from the compression chamber;

returning the second ram to the return position after ejecting the compressed material from the packaging receptacle; and wherein the step of returning the first ram to the initial position is initiated prior to the completion of the step of ejecting the compressed material from the packaging receptacle.

13. The method of claim 12 wherein the step of returning the first ram to the initial position is completed and additional compressible material is input into the compression chamber prior to the completion of the step of ejecting the compressed material from the packaging receptacle.

14. The method of claim 12 wherein the second ram is inserted into the inner volume as the second ram moves toward the ejection position during the step of ejecting the compressed material and the second ram is retracted from the inner volume as the second ram moves to the return position during the step of returning the second ram to the return position; and wherein the step of returning the first ram to the initial position is completed and additional compressible material is input into the compression chamber prior the retraction of the second ram from the inner volume.

15. The method of claim 14 further comprising the step of confining the compressed material within a packaging jacket as the compressed material is ejected from the inner volume.

16. The method of claim 15 wherein the compressed material is maintained in a substantially compressed condition within the inner volume during the step of moving the packaging receptacle from the first position to the second position.

17. The method of claim 11 wherein additional compressible material is input into the compression chamber prior to completing said step of ejecting.

18. The method of claim 11 further comprising the step of confining the compressed material within a packaging jacket.

19. The method of claim 11 further comprising the step of confining the compressed material within a packaging jacket as the compressed material is ejected from the inner volume and wherein, prior to ejecting the compressed material from the inner volume, the packaging jacket is disposed about the packaging receptacle.

20. The method of claim 19 wherein, during the ejection of the compressed material from the inner volume, the compressed material engages the packaging jacket thereby removing the packaging jacket from the packaging receptacle.

21. A method of compressing a compressible material, said method comprising:

inputting the compressible material into a compression chamber;

compressing the compressible material within the compression chamber;

providing a first ram moveable between an initial position and a discharge position;

providing a packaging receptacle moveable between a first position and a second position wherein the packaging receptacle defines an inner volume;

positioning the packaging receptacle in the first position and discharging the compressible material from the compression chamber in a compressed state and into the inner volume by movement of the first ram toward the discharge position;

moving the packaging receptacle from the first position to the second position with the compressed material disposed within the inner volume:

providing a second ram moveable between a return position and an ejection position;

ejecting the compressed material from the packaging receptacle by movement of the second ram toward the ejection position while the packaging receptacle is in the second position;

returning the first ram to the initial position after discharging the compressible material from the compression chamber;

returning the second ram to the return position after ejecting the compressed material from the packaging receptacle;

wherein the step of returning the first ram to the initial position is initiated prior to the completion of the step of ejecting the compressed material from the packaging receptacle;

wherein the second rain is inserted into the inner volume as the second ram moves toward the ejection position, during the step of ejecting the compressed material and the second ram is retracted from the inner volume as the second ram moves to the return position during the step of returning the second ram to the return position;

wherein the step of returning the first ram to the initial position is completed and additional compressible material is input into the compression chamber prior the retraction of the second ram from the inner volume;

confining the compressed material within a packaging jacket as the compressed material is ejected from the inner volume;

wherein the inner volume has first and second opposed openings and the compressed material is received from the outlet port through the first opening and is ejected from the inner volume through the second opening; and wherein reciprocal movement of the second ram between the return position and the ejection position alternatively extends and retracts the second ram into and from the inner volume through the first opening.

22. The method of claim 21 wherein prior to ejecting the compressed material from the inner volume, a sleeve of plastic film is disposed about the packaging receptacle to form the packaging jacket into which the compressed material will be ejected.

23. The method of claim 22 wherein the ejection of the compressed material from the inner volume into the plastic sleeve engages the compressed material with the plastic sleeve thereby removing the plastic sleeve from the packaging receptacle and drawing additional plastic film about the packaging receptacle; and further comprising the step of joining the plastic film together proximate the second opening following the ejection of the compressed material into the plastic sleeve to thereby seal the compressed material within the plastic sleeve and form the packaging jacket and separate the packaging jacket from the plastic film disposed about the packaging receptacle.

24. A method of compressing a compressible material, said method comprising:

inputting the compressible material into a compression chamber;

compressing the compressible material within the compression chamber;

providing a first ram moveable between an initial position and a discharge position;

providing a packaging receptacle moveable between a first position and a second position wherein the packaging receptacle defines an inner volume;

positioning the packaging receptacle in the first position and discharging the compressible material from the compression chamber in a compressed state and into the inner volume by movement of the first ram toward the discharge position;

moving the packaging receptacle from the first position to the second position with the compressed material disposed within the inner volume;

providing a second ram moveable between a return position and an ejection position;

ejecting the compressed material from the packaging receptacle by movement of the second ram toward the ejection position while the packaging receptacle is in the second position:

wherein the inner volume has first and second opposed openings and the compressed material is received from the outlet port through the first opening and is ejected from the inner volume through the second opening; and wherein reciprocal movement of the second ram between the return position and the ejection position alternatively extends and retracts the second ram into and from the inner volume through the first opening.

25. The method of claim 24 wherein prior to ejecting the compressed material from the inner volume, a sleeve of plastic film is disposed about the packaging receptacle, the ejected compressed material being received within the sleeve.

26. The method of claim 25 wherein the ejection of the compressed material from the inner volume into the sleeve engages the compressed material with the sleeve thereby removing the sleeve from the packaging receptacle and drawing additional plastic film about the packaging receptacle; and further comprising the step of joining the plastic film together proximate the second opening following the ejection of the compressed material into the sleeve to thereby seal the compressed material within the sleeve, whereby the sealed sleeve forms a packaging jacket, and separate the packaging jacket from the plastic film remaining on the packaging receptacle.

* * * * *